United States Patent [19]

Bianco

[11] 3,980,844

[45] Sept. 14, 1976

[54] COMBINATION LOCK AND SWITCH DEVICE

[76] Inventor: Eric L. Bianco, 120 E. Price St., Linden, N.J. 07036

[22] Filed: Apr. 22, 1975

[21] Appl. No.: 570,432

Related U.S. Application Data

[63] Continuation-in-part of Ser. No. 458,200, April 5, 1974, abandoned.

[52] U.S. Cl. ..... 200/43; 70/303 R

[51] Int. Cl.[2] ..... H01H 27/10

[58] Field of Search ..... 70/392, 303 R, 23, 314, 70/317, 333, 342; 240/274; 200/43, 45

[56] References Cited

UNITED STATES PATENTS 2,655,807 10/1953 Bateman ..... 70/303 R

*Primary Examiner*—Herman Hohauser

*Attorney, Agent, or Firm*—Daniel H. Bobis

[57] ABSTRACT

A combination lock and switch device includes, a housing, a bolt slidably mounted for movement in one side of said housing, a locking dog in the housing connected to the portion of the bolt disposed therein for sliding the same between the locked and unlocked positions, a dial on the exterior of said housing fixedly connected to a shaft disposed for rotatable movement by said dial in a clockwise and counter clockwise direction, and tumblers on said shaft each having a peripheral notch therein so that on rotation of said shaft the peripheral notches will align and coact with said locking dog to move the locking dog and bolt connected thereto to and from the locked and unlocked positions. The first of said tumblers having, a second peripheral notch a predetermined distance from the first peripheral notch to provide an alternate combination of aligned peripheral notches for coaction with the locking dog, and electrical switch means including a commutator bushing on said first tumbler, and contact means on said commutator bushing extending into the second peripheral notch for operative contact by the locking dog when the alternate combination of peripheral notches are aligned with each other.

5 Claims, 7 Drawing Figures

COMBINATION LOCK AND SWITCH DEVICE

BACKGROUND OF THE INVENTION

This application is a continuation-in-part of my copending application U.S. Ser. No. 458,200, now abandoned.

The present invention relates generally to combination locks for actuating switches in an electrical circuit and more particularly to a combination lock and switch device which enables the lock to provide not only the normal manner of operation but also to permit the operator to select an alternate combination so as to activate an associated switch therein of an electric alarm circuit or other signal.

The use of permutation type combination locks having a switch means for controlling an electrical circuit as an anti-theft device is known. For example such locks can be found in U.S. Pat. Nos. 1,345,787, 2,655,807, 2,797,271, 2,984,717, 3,281,549 and 3,627,938.

In U.S. Pat. No. 2,655,807 a permutation type combination lock operatively associated with a switch device is utilized for operating an associated alarm means. In this patent the tumblers may be aligned in one of two positions. In one position the combination lock coacts with a locking dog so that the lock may be used to open and close a bolt of an associated latching means in the conventional manner. In the second position the notches are orient to coact with a second lever member which acts not to open the lock in the conventional manner but to simulate a time element and to actuate a switch device for operating an associated electric alarm system.

The obvious purpose and object of such alternate means being to act as an anti-theft device whereby a signal will be given to indicate a theft or hold-up in progress.

The danger of this device is that in the alternate position the lock will not open the bolt of the associated latching means in the conventional manner. Accordingly, the operator who is compelled by a thief at gun point to open such lock is in grave danger if he elects to utilize the alternate combination.

In the improved combination lock in accordance with the present invention, the operator can utilize the alternate combination by merely adding a predetermined additional number of digits to one of the numbers of the regular combination which so aligns notches in the tumblers that when the locking dog of the bolt drops into the aligned notches, a switch will be closed in a clandestine manner setting off the desired alarm while still allowing the lock to be opened in the normal manner.

SUMMARY OF THE INVENTION

Thus the present invention covers a combination lock and switch device including, a housing having a permutation lock formed therein, a bolt operatively associated with said lock, said lock having a plurality of tumblers and each of said tumblers having a peripheral notch therein, and means on said lock to operate said plurality of tumblers so the peripheral notch in each of said tumblers will be in alignment, locking dog means connected to said bolt and operatively associated with said tumblers to engage the aligned peripheral notches so that on operation of the lock said bolt will be moved between the locked and the unlocked positions, at least one of said tumblers having a second peripheral notch therein a predetermined angular distance from the first peripheral notch, and said means for operating said tumblers adaptable to alternatively align the second peripheral notch instead of the first peripheral notch on the given tumbler having said second peripheral notch on said one tumbler and operable by said locking dog to actuate the electrical system when said second peripheral notch is aligned with said first peripheral notch.

Accordingly, it is an object of the present invention to provide a combination lock and switch device which provides an operator with a dual combination in which one of the combinations may be obtained merely by varying the position of at least one of the tumblers and wherein the switch device coacts with this one combination for actuating an electrical alarm or other circuit.

It is another object of the present invention to provide a combination lock and switch device for an electrical system to be used as an anti-theft means.

These and other objects and advantages of the invention will become apparent to those skilled in the art from the following detailed description of a preferred embodiment thereof with reference to the accompanying drawings in which.

Figure 1:
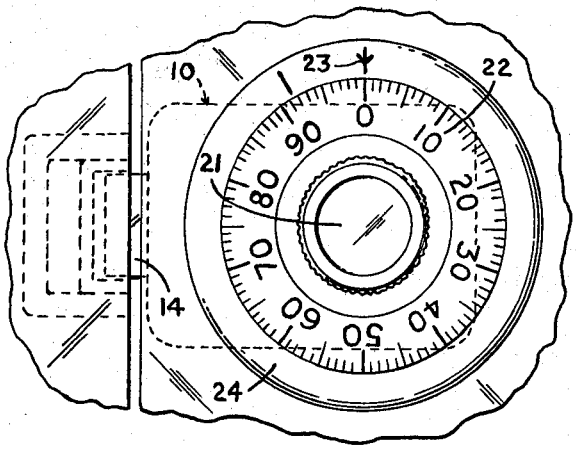
FIG. 1 is a front view of the combination lock and switch device in accordance with the present invention having the bolt associated therewith.
Figure 3:
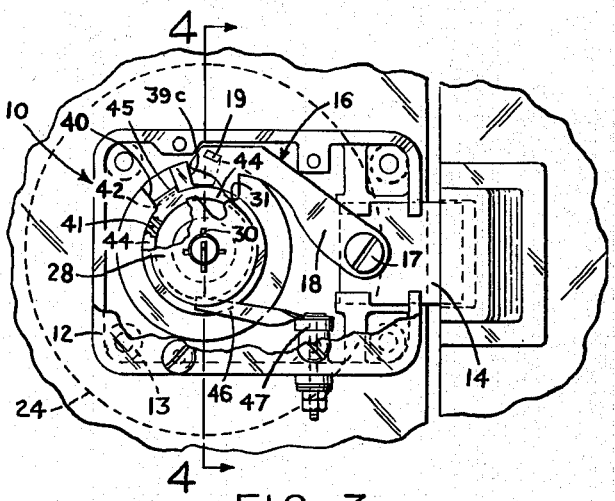
FIG. 3 is a back view of the combination lock and switch device shown in FIG. 1 with the back cover broken away.
Figure 2:
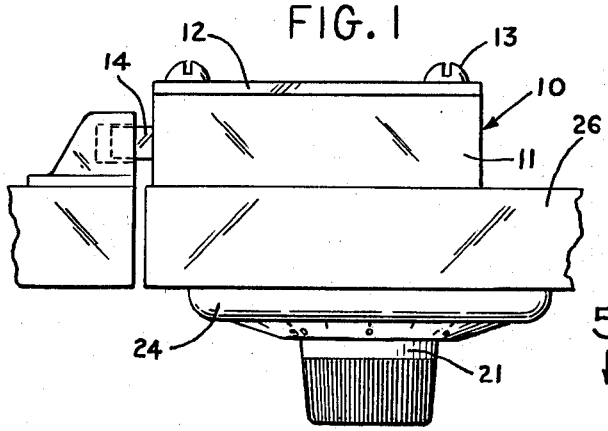
FIG. 2 is a top view of the combination lock and activated switch in FIG. 1.

Referring to the drawings FIGS. 1 to 6 show the combination lock and switch device generally designated 10 in accordance with the present invention.

The portion of the present invention that relates to the combination lock is similar in most respects to the well known combination locks sold on the open market by Saergent and Greenleaf under the designation Group 2 Key Chain Combination Locks. Such locks may have the combinations therein easily altered by means of a key which is inserted through the back end of the housing. This is a desirable feature as an anti-theft device and is well known in this art.

It is mentioned because in the present invention the changing of the combination for any such lock to a different combination will not effect the mechanism which provides the dual combination for the anti-theft method and operation of the present invention now to be more fully described.

The combination lock and switch device 10 includes a housing 11 which has a removable end cover 12 connected thereto by any suitable means such as threaded members 13.

Housing 11 will be connected in any convenient assembly point to coact with a latching means having a bolt 14 which is slidably disposed in one wall 15 of the housing 11. Bolt 14 is slidable between the locked and unlocked positions by means of a locking dog 16 which is pivotally connected as at 17 to the end of the bolt 14 in housing 11.

Figure 4:
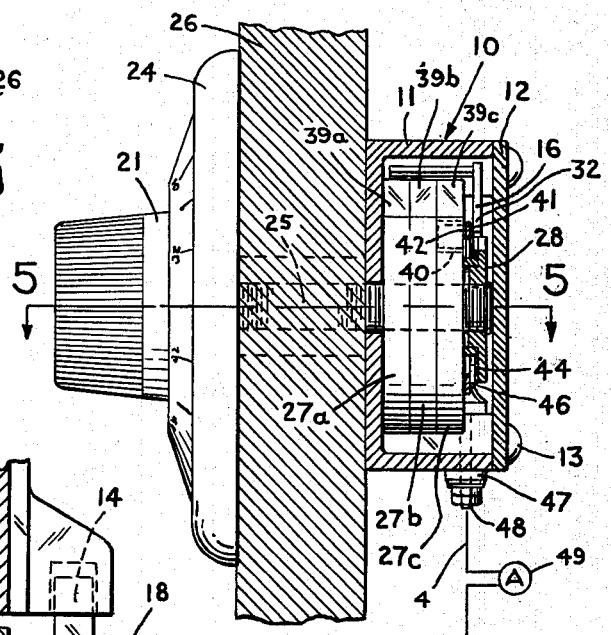
FIG. 4 is a vertical section taken on line 4—4 of FIG. 3 including a diagramatic sketch of an associated electrical system.
Figure 5:
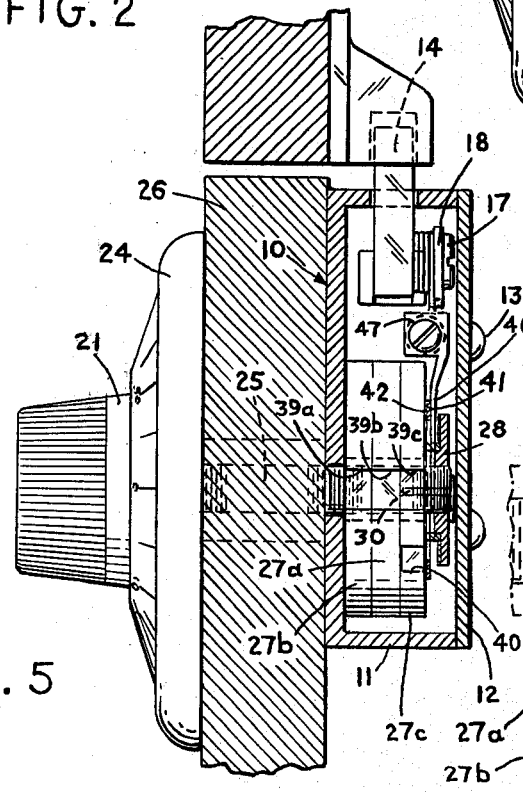
FIG. 5 is a horizontal section taken on line 5—5 of FIG. 4.
Figure 5A:
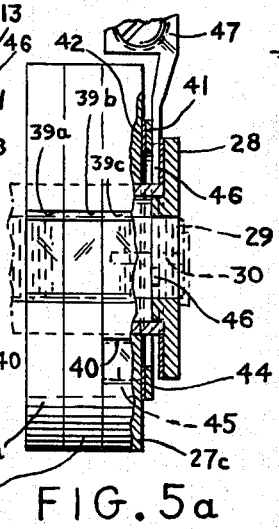
FIG. 5A is an enlarged view of a part of FIG. 5 to show the insulated member and associated commutator and brush element of the switch for the electrical circuit.
Figure 6:
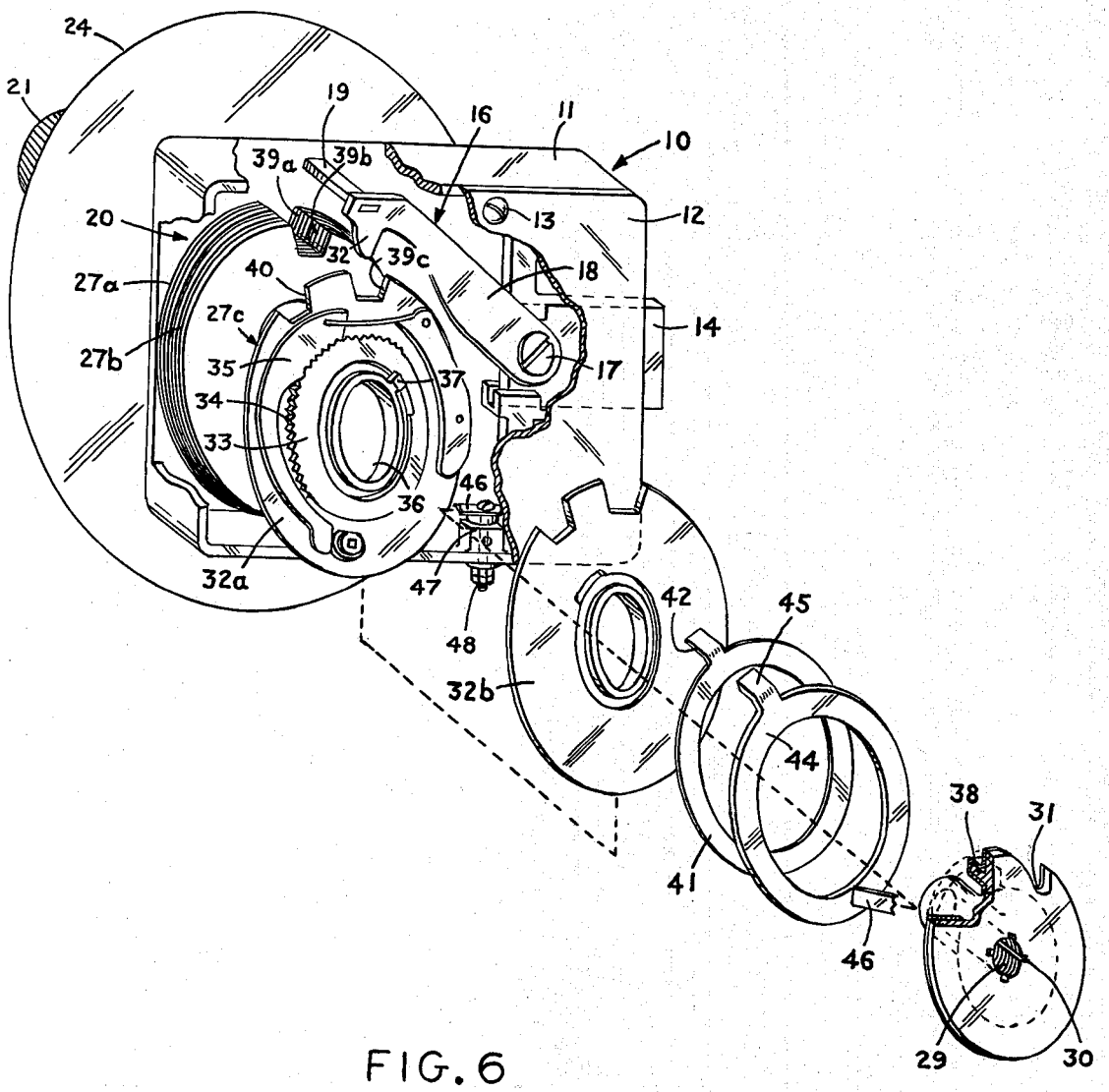
FIG. 6 is a perspective view of the combination lock and activated switch shown in FIG. 1 showing the first tumbler assembly and the associated commutator and brush elements of the switch for the electrical circuit in exploded form.

The locking dog 16 as shown in FIGS. 4, 5 and 6 is a substantially L-shaped member which includes an elongated leg 18 disposed substantially parallel to the longitudinal line of movement of the bolt 14 and a transverse leg 19 which is at the end of the locking dog remote from the point where it is pivotally connected to the bolt 14.

Transverse leg 19 is operatively associated with a combination lock generally designated 20 which when properly oriented as is more fully described below will engage the transverse leg and by movement thereof move the locking dog and the associated bolt 14 in and out of the locked and unlocked positions by clockwise rotation of the combination lock as is well understood by those skilled in the art.

The combination lock 20 includes, a dialing knob 21 having indicia numerals as at 22 inscribed on the front face cooperable with a fixed indicator means 23 on the rim of a mounting flange 24. Dialing knob 21 is fixedly connected to one end of a drive shaft 25 and is mounted on the wall element 26 to which the housing 11 is connected so that the shaft 25 can extend into the housing as is shown in FIGS. 4 and 5 of the drawings.

Drive shaft 25 is rotatably mounted in the housing substantially transverse to the longitudinal line of movement of the bolt 14 and parallel to the transverse leg 19 of the locking dog 16.

The drive shaft also serves to support a plurality of tumblers generally designated 27*a*, 27*b*, 27*c* and 27*d* and the tumblers are held on the drive shaft by means of a drive wheel 28 which is threadibly connected as at 29 to the end of the drive shaft remote from the dialing knob 21.

The drive wheel has a key 30 therein for positioning a notch 31 extending radially inward from the periphery which coacts with a projecting dog 32 on the locking dog 16 when the tumblers are brought into proper alignment by rotating the indicia 22 on the dialing knob 21 in accordance with the combination for which the combination lock is set.

All of the tumblers have a substantially similar construction except that the first tumbler 27*a* is modified as will be described more fully hereinafter to provide the desirable construction and operation on which the present invention depends.

FIG. 6 has the said tumbler 27*a* shown in detail for this reason but each of the other tumblers 27*b*, 27*c* and 27*d* have a substantially similar construction as will be apparent from the description of tumbler 27*a*.

Thus referring to FIG. 6 the tumbler 27*a* consists of a metal sandwich consisting of two large outer plates as at 32*a* and 32*b* which enclose and hold between them a ring 33.

The ring 33 has a plurality of teeth 34 on the circumference thereof which when engaged by lever means 35 will act to lock the ring 33 and the large plates 32*a* and 32*b* so they rotate as a unit. When the lever means 35 is released the ring 33 is free to rotate relative the spaced plates 32*a* and 32*b* and this constitutes the mechanism for changing the point where the tumbler will be positioned when the combination for the combination lock is dialed. Since this is a well known expedient in the prior art it is not more fully described.

The ring member 32 has an axial opening 36 therethrough and the drive shaft 25 extends through each of the axial openings of the ring members on the respective tumblers 27*a*, 27*b*, 27*c* and 27*d* so that they are rotatably supported thereon in operating position. The ring 33 is shown to have a stud 37 therein and each of the corresponding rings on the tumblers 27*b*, 27*c* and 27*d* will have similar studs.

All of the studs are disposed the same radial distance from the axis of the drive shaft and can therefore rotate in the same circumferential plane. However, the studs are disposed at different angular positions in this circumferential plane and the rings on the respective tumblers accordingly can be rotated clockwise and counter clockwise through arcs depending on the relative angular distance of the stud positions before they will come into driving engagement with each other.

The tumblers are brought into driving engagement by the drive wheel 28 which has a driving pin 38 also disposed the same radial distance from the axis of the drive shaft and accordingly rotatable in the same circumferential plane as each of the studs.

Thus when the dialing knob 21 is rotated the drive shaft 25 will rotate the drive wheel 28 and cause the drive pin 38 to engage and drive the next adjacent tumbler, which in this instance is tumbler 27*c*, when the drive pin engages the stud 37 on the ring 33.

A stud not shown on the opposite side of ring 33 is disposed for engagement with the next adjacent stud on the next adjacent ring of tumbler 27*b* and when this back stud engages the next adjacent stud it will act to rotate tumbler 27*b* and as will be understood by those skilled in the art the studs on each ring engage the studs of the next adjacent rings so as to drive the respective tumblers 27*b* and 27*a*.

Further it will be noted that the respective tumblers 27*a*, 27*b* and 27*c* have at least one peripheral notch therein as at 39*a*, 39*b* and 39*c*.

When the dialing knob is dialed the proper number of turns to a given indicia number and all the indicia numbers are duly combined the tumblers will be so oriented that the peripheral notches 39*a*, 39*b* and 39*c* will be in alignment with each other. Then by turning the dialing knob 21 to the last of the numbers for the given combination of the lock inwardly radially extending notch 31 on the drive wheel 28 will be brought into operative engagement with the dog 32 on the locking dog 16 because with the peripheral notches 39*a*, 39*b*, and 39*c* in aligned position the transverse leg 19 will drop into engagement with these aligned peripheral notches and the dog 32 will then be able to engage the peripheral notch 31 on the drive wheel 28.

At this position by reversing the direction of rotation of the dialing knob 21 the drive wheel 28 will hook and pull the locking dog 16 and the associated bolt 14 to the unlatched position.

In this position the combination lock can lock and unlock the associated bolt as long as the combination for maintaining the tumblers in aligned position is not modified.

However, once the tumblers are misaligned then in order to once again permit the combination lock to move the bolt 14 between the locked to unlocked position, the tumblers must be realigned by once again dialing the dialing knob to the proper combination of turns and indicia positions as has been above described.

The elements and operation of the combination lock above described is conventional and well known and hence no further detailed description is deemed necessary as this operation will be clearly understood by those skilled in the art.

The present invention however differs from the conventional combination locks in that one of the tumblers as for example, tumbler 27*a* is provided with a second peripheral notch as at 40 which is spaced a predetermined distance from the first peripheral notch 39*a*. For example if this angular distance is represented by ten indicia numbers then no matter what combination is placed into the combination lock there is always provided an alternate combination by merely adding the additional number of digits equivalent to the angular distance that the second peripheral notch is angularly spaced from the first peripheral notch on the one tumbler so constructed.

In the present invention this second peripheral notch not only provides a combination lock with two alternate combinations for opening the lock but additionally enables the alternate combination to be utilized as an electrical switch for actuating an alarm or other signal.

In this arrangement one combination can be used in conventional fashion without actuating the electrical circuit and when necessary or desirable the alternate combination can be utilized for actuating the associated electrical circuit.

Thus, referring to FIGS. 4, 5 and 6 of the drawings the tumbler 27*c* is shown to include an annular ring 41 of insulating material which has an insulated tab 42 normal to the periphery thereof. In assembled position the annular insulator ring 41 is epoxied or adhesively connected to the outer face of plate 32*b* so that the insulated tab 42 lies in the second peripheral notch 40 as is shown in FIGS. 4 and 5 of the drawings.

Mounted on the insulator is an annular commutator ring 44 having a contact element 45 thereon also extending normal to the periphery of the commutator so that the commutator can be mounted as by epoxy or other suitable adhesive on the insulator ring 41 with the contact element 45 lieing in the second peripheral notch 40 but not in contact with the tumbler element 27*c*.

The commutator element is associated with a brush member 46 which is connected to an insulated contact post 47 at one end and extends inwardly of the drive wheel 28 so that it lies in contact with the commutator 44. The contact post communicates by line 48 to an alarm or other signal 49 which is in turn connected to any suitable power source such as a conventional battery 50 which will be grounded as at 51 to complete the circuit.

OPERATION OF SIGNAL CIRCUIT

In operation when the combination is dialed the additional digits, the second peripheral notch 40 on tumbler 27*a* will align with the peripheral notches 39*b*, 39*c* and 39*d* on tumblers 27*b*, 27*c* and 27*d* and on movement of the dialing knob to the last combination number or the opening position for the lock, the transverse leg 19 of the locking dog will fall into all of the aligned notches.

When this occurs the transverse leg will make contact with the contact tab 45 on the commutator 44. Since the housing and all the parts thereof are grounded a complete electrical circuit is formed. The transverse leg 19 and contact tab 45 acting as a switch to activate the electrical circuit in that current can now pass from the battery through the alarm signal line 51, contact post 50, brush 49 and commutator 45 through the switch to ground.

While this operation is occurring, the combination lock will still open in the conventional fashion as if this were the regular combination for the given lock.

It is obvious that this arrangement provides means for creating an alarm signal in a clandestine manner without interrupting the normal operation of the lock.

Further this construction is particularly applicable to locks wherein the combination can be altered and in the new combination the alternate or second combination will still be the same predetermined number of indicia on the same given tumbler as in the previous combination for the given lock.

It will be understood that the invention is not to be limited to the specific construction or arrangement of parts shown but that they may be widely modified within the invention defined by the claims.

What is claimed is:

1. A combination lock and switch device including, a. a housing, b. a plurality of tumblers in said housing adapted to be rotated in accordance with a given combination, c. each of said plurality of tumblers having at least one notch in the peripheral edge thereof, d. means to rotate said tumblers relative to each other according to a given first combination to bring the respective peripheral notches into alignment with each other, e. a locking dog disposed to coact with said aligned peripheral notches according to said first combination, f. one of said tumblers having a second notch in the periphery spaced an angular distance from the first notch therein, g. each of said plurality of tumblers adapted to be aligned according to a second combination so as to bring the peripheral notches of the tumblers into alignment with the second notch on said one tumbler and to permit coaction with said locking dog in the aligned position for the second combination and, h. switch means operatively associated with said second notch in said one tumbler and with the locking dog when said plurality of tumblers are aligned in the second combination position whereby said switch means can actuate an associated electrical system.

2. In the combination as claimed in claim 1 wherein the one tumbler having two notches therein includes, a. contact means connected in said second notch to provide one pull means for the switch means of the associated electrical circuit, b. said locking dog to provide the other pull means for said switch mean, and c. said locking dog to move into and out of engagement with the said contact means as a function of the alignment of the second notch with the peripheral notches in each of the plurality of tumblers.

3. In the combination as claimed in claim 2 wherein the contact means includes, a. an insulator connected to said tumbler having the two notches therein and having a tab extended into the second notch, b. a commutator made of conductive material connected to the side of the insulator remote from the side connected to the tumbler having the two notches therein, and c. brush means on said housing disposed to engage the commutator for connecting said contact means to one side of said associated electrical circuit.

4. A combination lock and switch comprising, a. a housing, b. a bolt slidably mounted in said housing c. a locking dog in said housing connected at one end to said bolt and operable to move said bolt between a locked and unlocked position.

d. dial means on said housing, e. a shaft rotatably mounted in said housing fixedly connected to and moveable by said dial means, f. a plurality of tumblers in said housing rotatably mounted on said shaft, g. each of said pluralities of tumblers having at least a first peripheral notch formed therein, h. at least one of said plurality of tumblers having a second peripheral notch formed therein a predetermined angular distance from said first peripheral notch on said one tumbler, i. said plurality of tumblers rotatable to align the first peripheral notch on each of the plurality of tumblers and alternatively to align the first peripheral notch on said plurality of tumblers with the second peripheral notch on said one tumbler.

j. said locking dog to engage in the notches of the tumblers when so aligned, k. an electrical circuit having switch means in said housing operatively associated with said second peripheral notch on said one tumbler, and

1. said switch means operable on engagement of the locking dog in the aligned first peripheral notches of said plurality of tumblers with the second notch in said one tumbler to actuate the associated electrical circuit.

5. In a combination lock and switch as claimed in claim 4 wherein said switch means includes, a. a commutator on said one tumbler having the second notch spaced from the first notch thereon, b. insulator means insulating the commutator from any conductive material on the said one tumbler, c. contact means mounted in said housing disposed in engagement with said commutator, and d. means connecting said contact means to the associated electrical circuit.

* * * * *